US007578394B2

(12) United States Patent
Wojciechowski et al.

(10) Patent No.: US 7,578,394 B2
(45) Date of Patent: Aug. 25, 2009

(54) METHOD AND APPARATUSES FOR SCREENING

(75) Inventors: Keith Wojciechowski, Lakeview, NY (US); Christian Newman, Lakeview, NY (US)

(73) Assignee: Derrick Corporation, Buffalo, NY (US)

( * ) Notice: Subject to any disclaimer, the term of this patent is extended or adjusted under 35 U.S.C. 154(b) by 330 days.

(21) Appl. No.: 11/726,589

(22) Filed: Mar. 21, 2007

(65) Prior Publication Data

US 2008/0230448 A1 Sep. 25, 2008

(51) Int. Cl.
*B07B 1/42* (2006.01)
*B07B 1/06* (2006.01)

(52) U.S. Cl. ..... 209/364; 209/274; 209/275; 209/276

(58) Field of Classification Search ..... 209/274, 209/275, 276, 364
See application file for complete search history.

(56) References Cited

U.S. PATENT DOCUMENTS

| | | | | |
|---|---|---|---|---|
| 4,816,153 | A * | 3/1989 | Ando et al. | 210/445 |
| 4,846,352 | A * | 7/1989 | Bailey | 209/399 |
| 5,615,776 | A * | 4/1997 | Bjorklund et al. | 209/403 |
| 7,216,768 | B2 * | 5/2007 | Fisher et al. | 209/395 |
| 2002/0175111 | A1 * | 11/2002 | Crabbe et al. | 209/269 |
| 2004/0007508 | A1 * | 1/2004 | Schulte et al. | 209/403 |
| 2006/0180509 | A1 * | 8/2006 | Burnett et al. | 209/405 |

* cited by examiner

*Primary Examiner*—Patrick H Mackey
*Assistant Examiner*—Terrell H Matthews
(74) *Attorney, Agent, or Firm*—Adams and Reese LLP; Jason P. Mueller

(57) ABSTRACT

A screening machine includes wall members, a screen assembly, and a compression assembly. The screen assembly includes a frame with a plurality of side members and a screen supported by the frame. The compression assembly is attached to at least one wall member and forms the screen assembly into a concave shape.

38 Claims, 10 Drawing Sheets

METHOD AND APPARATUSES FOR SCREENING

FIELD OF THE INVENTION

The present invention relates generally to material screening. More particularly, the present invention relates to a method and apparatuses for screening.

BACKGROUND INFORMATION

Material screening includes the use of vibratory screening machines. Vibratory screening machines provide the capability to excite an installed screen such that materials placed upon the screen may be separated to a desired level. Oversized materials are separated from undersized materials. Over time, screens wear and require replacement. As such, screens are designed to be replaceable.

Vibratory screening machines and their replaceable screens have several drawbacks that limit their productivity and use. In vibratory screening machines, the material to be separated is placed on flat or corrugated replaceable screens. The replaceable screens are tensioned over a surface of the vibratory screening machine such that the replaceable screen tightly fits on the machine. A tensioning arrangement is provided with the machine and is used to provide a tensioning force on the screen. Several techniques are used to tension screens on vibratory screening machines. One technique includes the use of special attachment hooks that grip the sides of the screen and pull it onto a surface of the machine. Replaceable screens have a substantially planar screen area and material often builds up at the screen edges causing maintenance and contamination problems.

SUMMARY

In an example embodiment of the present invention, a vibratory screening machine is provided that simplifies the process of securing a replaceable screen to the machine. The vibratory screening machine and replaceable screen prevent materials to be separated from flowing over the sides of the screen. The replaceable screen is designed to be cost effective and can be quickly installed on the vibratory screening machine.

According to an example embodiment of the present invention, a vibratory screen machine includes: wall members, a concave support surface, a central member attached to the support surface, a screen assembly, a compression assembly and an acceleration arrangement. The screen assembly includes a frame having a plurality of side members and a screen supported by the frame. The screen includes a semi-rigid support plate and a woven mesh material on a surface of the support plate. The compression assembly is attached to an exterior surface of a wall member. The compression assembly includes a retractable member that advances and contracts. The acceleration arrangement is configured to impart an acceleration to the screen. As the retractable member advances it pushes the frame against the central member forming the screen assembly into a concave shape against the concave mating surface. The top surface of the screen assembly forms a concave screening surface.

According to an example embodiment of the present invention, a vibratory screen machine includes: a screen assembly; and a compression assembly. The compression assembly deforms a top surface of the screen assembly into a concave shape.

The screen assembly may include a frame having a plurality of side members and a screen supported by the frame. At least one side member may be at least one of a tube member, a formed box member and a formed flange.

The vibratory screen machine may include a wall member. The compression assembly may be attached to at least one wall member and may be positioned on an exterior of a wall member.

The vibratory screen machine may include an acceleration or vibration arrangement configured to impart an acceleration to the screen assembly.

The vibratory screen machine may include a support surface wherein the screen assembly forms a concave shape against the support surface.

The vibratory screen machine may include a central member. The screen assemblies may be arranged between the central member and wall members. The central member may be attached to the support surface. The central member may include at least one angled surface configured to urge the screen assembly into a concave shape in accordance with the deformation of the screen assembly by the compression assembly. A side member may be in contact with the central member and another side member may be in contact with the compression assembly.

The vibratory screen machine may include at least one additional screen assembly having a second frame having a plurality of second side members and a second screen supported by the second frame. A second side member of the additional screen assembly may be in contact with the central member and a side member of the screen assembly may be in contact with the compression assembly. The top surfaces of the at least two screen assemblies may be formed into a concave shape.

The vibratory screen machine may include a second compression assembly and a second screen assembly including a plurality of second side members. A second side member may be in contact with the central member and another second side member may be in contact with the second compression assembly.

The vibratory screen machine may include a mating surface configured to contact the screen assembly. The mating surface may include at least one of rubber, aluminum and steel. The mating surface may be a concave surface.

The at least one compression assembly may include a pre-compressed spring that is configured to assert a force against the screen assembly. The pre-compressed spring may assert a force against at least one side of the frame.

The compression assembly may include a mechanism configured to adjust the amount of deflection imparted to the screen assembly. The amount of deflection imparted to the screen may be adjusted by a user selectable force calibration.

The compression assembly may include a retractable member that advances and contracts. The retractable member may advance and contract by at least one of a manual force, a hydraulic force and a pneumatic force.

The vibratory screen machine may include at least one additional compression assembly. The compression assemblies may be configured to provide a force in the same direction.

According to an example embodiment of the present invention, a screen assembly for a vibratory screening machine includes: a frame including a plurality of side members and a screen supported by the frame. The screen assembly may be configured to form a predetermined concave shape when placed in the vibratory screening machine and subjected to a compression force by a compression assembly of the vibratory screening machine against at least one side member of the screen assembly. The predetermined concave shape may be determined by a surface of the vibratory screening machine.

At least two side members may be at least one of tube members, box members and formed flanges.

The screen assembly may include a mating surface configured to interact with a surface of the vibratory screening machine. The mating surface may include at least one of rubber, aluminum and steel.

The screen may include a woven mesh material and the frame may include formed flanges on at least two sides.

The frame may include a perforated semi-rigid support plate and the screen may include a woven mesh material. The woven mesh material may be attached to the support plate by at least one of gluing, welding and mechanical fastening.

The screen may include at least two layers of woven mesh material.

The frame may include a semi-rigid perforated support plate and the screen may include at least two layers of a woven mesh material in an undulating shape. The at least two layers of woven mesh material may be attached to the support plate by at least one of gluing, welding and mechanical fastening.

The plate may include a semi-rigid perforated support plate and the screen may include at least three layers of a woven mesh material in an undulating shape. The at least three layers of woven mesh material may be attached to the support plate by at least one of gluing, welding and mechanical fastening.

According to an example embodiment of the present invention, a method for screening materials includes: attaching a screen assembly to a vibratory screen machine and forming a top screening surface of the screen assembly into a concave shape. The method may also include accelerating the screen assembly. The method may also include returning the screen assembly to an original shape, replacing the screen assembly with another screen assembly and performing the attaching and forming steps on another screen assembly.

DETAILED DESCRIPTION

Figure 1:
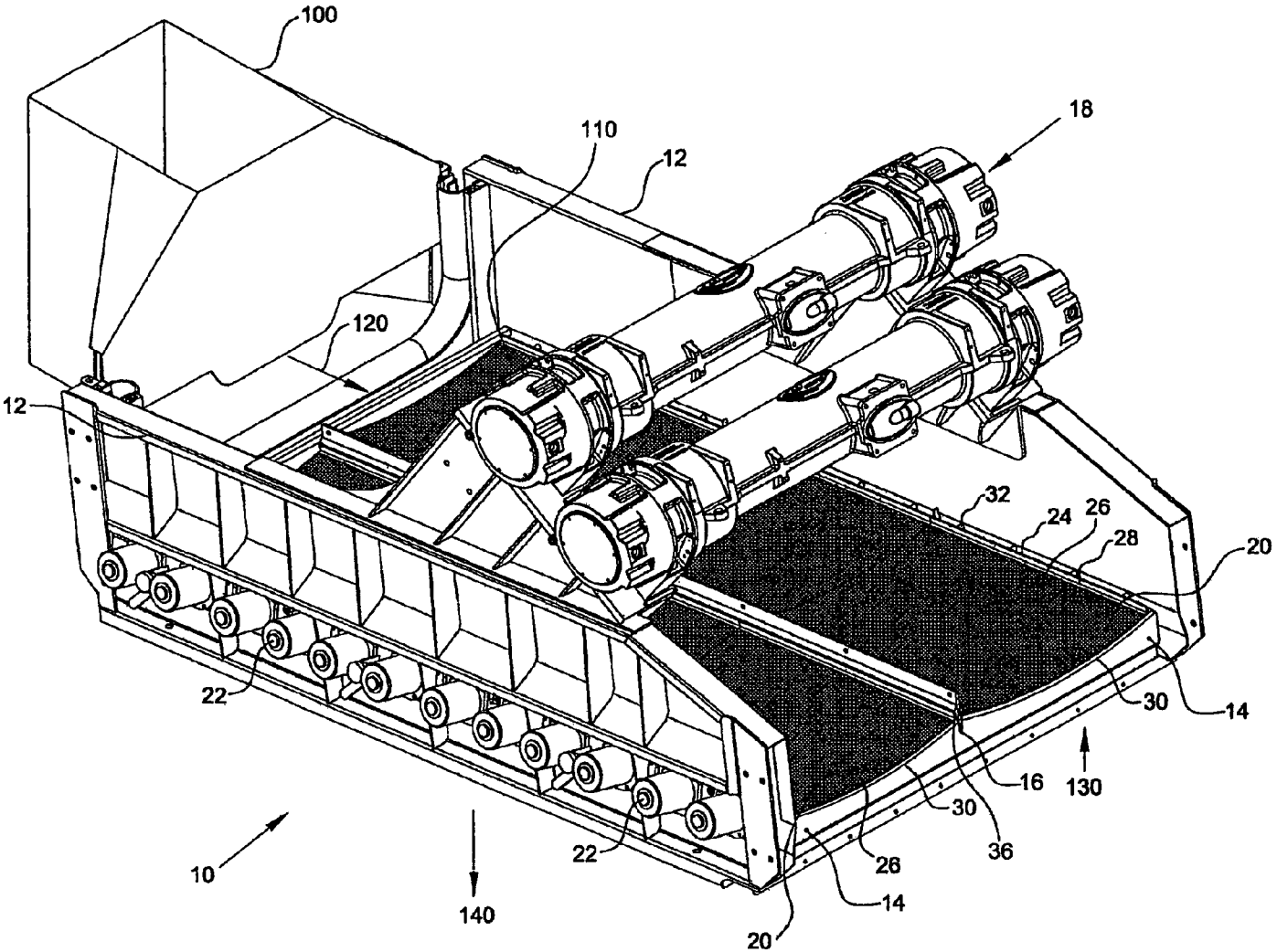
FIG. 1 shows a perspective view of a vibratory screen machine with installed replaceable screen assemblies according to an example embodiment of the present invention.

Like reference characters denote like parts in the drawings.

FIG. 1 shows vibratory screening machine 10 with installed replaceable screening assemblies 20. Material is fed into a feed hopper 100 and is then directed onto a top surface 110 of the screen assemblies 20. The material travels in flow direction 120 toward the vibratory screening machine 10 end 130. The material flowing in direction 120 is contained within the concave configuration provided by the screen assemblies 20. The material is prevented from exiting the sides of screen assemblies 20. Material that is undersized and/or fluid passes through screen assemblies 20 onto a separate discharge material flow path 140 for further processing. Materials that are oversized exit end 130. The material stream may be dry, a slurry, etc., and the screen assemblies 20 may be pitched downwardly from the hopper 100 toward an opposite end in the direction 120 to assist with the feeding of the material.

Vibratory screening machine 10 includes wall members 12, concave support surfaces 14, a central member 16, an acceleration arrangement 18, screen assemblies 20 and compression assemblies 22. Central member 16 divides vibratory screening machine 10 into two concave screening areas. Compression assemblies 22 are attached to an exterior surface of wall members 12. Vibratory screening machine 10 may, however, have one concave screening area with compression assemblies 22 arranged on one wall member. Such an arrangement may be desirable where space is limited and maintenance and operational personnel only have access to one side of the vibratory screening machine. Also, multiple screening areas may be provided.

While vibratory screening machine 10 is shown with multiple longitudinally oriented screen assemblies creating two parallel concave material pathways, screen assemblies 20 are not limited to such a configuration and may be otherwise oriented. Additionally, multiple screening assemblies 20 may be provided to form a concave screening surface (see, e.g., FIG. 9).

Screen assemblies 20 include frames 24 and screens 26. Frames 24 include side members 28. Side members 28 are formed as flanges but may be formed of any elongated member such as tubes, formed box members, channels, plates, beams, pipes, etc. Screens 26 may include a semi-rigid perforated support plate 80 and a woven mesh material 82 on a surface 84 of the support plate 80 (see, e.g., FIG. 4). Support plate 80 need not be perforated but may be configured in any manner suitable for the material screening application. The woven mesh material may have two or more layers. The layers of a woven mesh material may be in an undulating shape. The woven mesh material may be attached to the semi-rigid support plate by gluing, welding, mechanical fastening, etc. Screens 26 are supported by frames 24.

As discussed above, compression assemblies 22 are attached to an exterior surface of wall members 12. Compression assemblies 22 include a retractable member 32 (see, e.g., FIG. 2) that extends and contracts. Retractable member 32 is a pin but may be any member configured to exert a compressive force against frame 24 to urge side members 28 toward each other to deform screen assemblies 20 into a concave profile. As set forth below, retractable members 32 advance and contract by a pneumatic and spring forces but may also advance and contract by manual forces, hydraulic forces, etc. Also as set forth below, compression assembly 22 may be configured as pre-compressed springs (see, e.g., FIGS. 6 to 8). Compression assemblies 22 may also be provided in other configurations suitable for providing a force against screen assemblies 20.

As shown in FIG. 1, compression assemblies 22 include retractable members 32, which are illustrated in FIG. 1 in an extended position asserting a force against frames 24. Frames 24 are pushed against central member 16 causing screen assemblies 20 to form a concave shape against support surfaces 14. Central member 16 is attached to support surface 14 and includes angled surfaces 36 (see, e.g., FIGS. 2 and 3) that prevent frames 24 from deflecting upward when they are compressed. Support surfaces 14 have a concave shape and include mating surfaces 30. Support surfaces 14 may, however, have different shapes. Also, central member 16 need not be attached to support surface 14. Additionally, vibratory screening machine 10 may be provided without support surfaces. Screen assemblies 20 may also include mating surfaces that interact with the mating surfaces 30 of support surface 14. The mating surfaces of screen assemblies 20 and/or the mating surfaces 30 may be made of rubber, aluminum, steel or other materials suitable for mating.

Acceleration arrangement 18 is attached to vibratory screening machine 10. Acceleration arrangement 18 includes a vibrator motor that causes screen assemblies 20 to vibrate.

Figure 2:
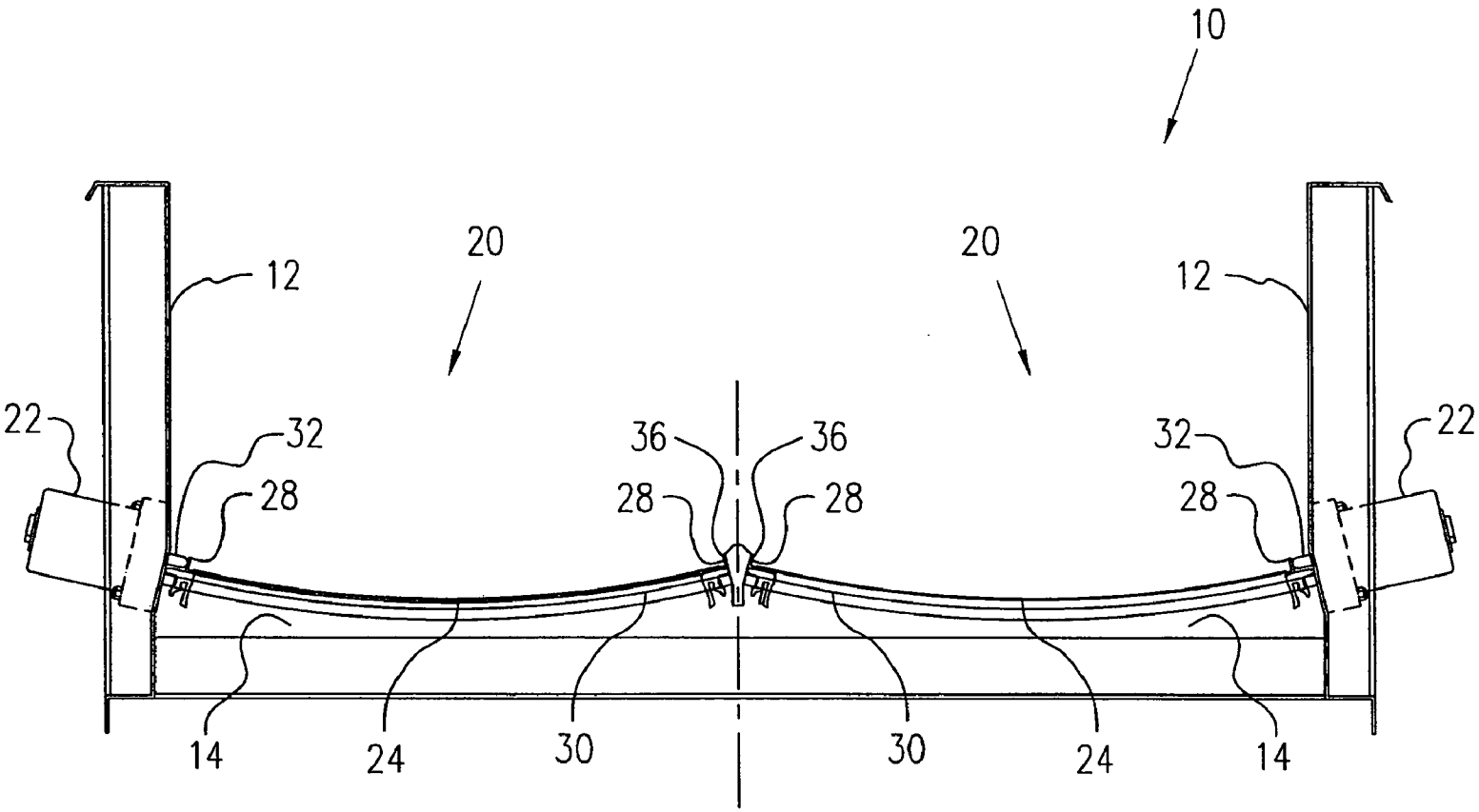
FIG. 2 shows a cross-sectional view of the vibratory screen machine shown in FIG. 1.

FIG. 2 shows the side walls 12, screen assemblies 20, compression assemblies 22 and support members 14 of the vibratory screening machine 10 shown in FIG. 1. Frames 24 of screen assemblies 20 include side members 28. The side members 28 form flanges.

As described above, compression assemblies 22 are mounted to wall members 12. Retractable members 32 are shown holding screen assemblies 20 in a concave shape. Materials to be separated are placed directly on the top surfaces of screen assemblies 20. Also as described above, the bottom surfaces of screen assemblies 20 may include mating surfaces. The bottom surfaces of screen assemblies 20 interact directly with the mating surfaces 30 of concave support surfaces 14 such that screen assemblies 20 are subjected to vibrations from acceleration arrangement 18 via, e.g., concave support surfaces 14.

The placement of the top surfaces of screen assemblies 20 into a concave shape provides for the capturing and centering of materials. The centering of the material stream on screen assemblies 20 prevents the material from exiting the screening surface and potentially contaminating previously segregated materials and/or creating maintenance concerns. For larger material flow volumes, the screen assemblies 20 may be placed in greater compression, thereby increasing the amount of arc in the top surface and bottom surface. The greater the amount of arc in the screen assemblies 20 allows for greater retaining capability of material by the screen assemblies 20 and prevention of over spilling of material off the edges of the screen assemblies 20.

Figure 3:
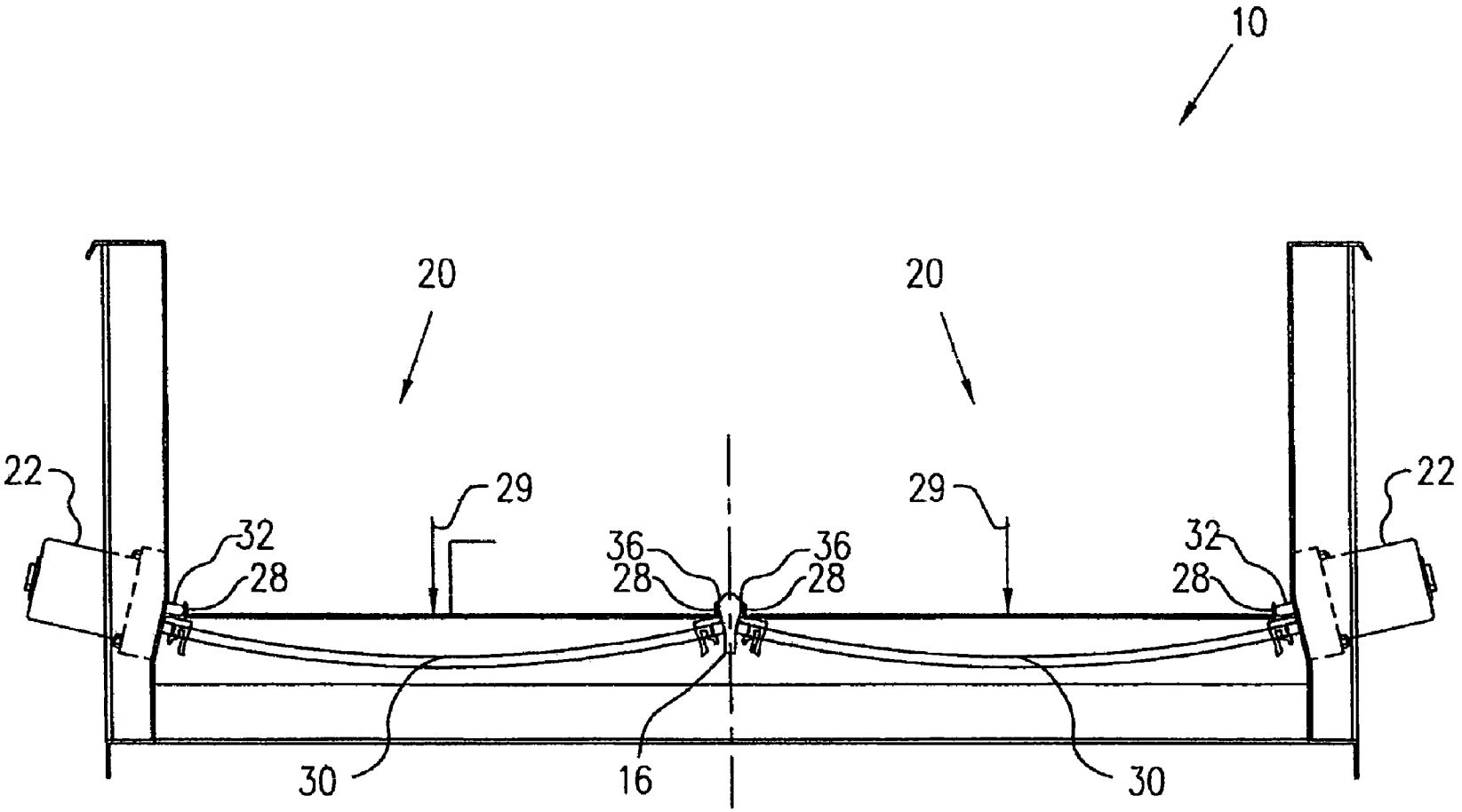
FIG. 3 shows a cross-sectional view of a vibratory screen machine with replaceable screen assemblies prior to final installation.

FIG. 3 shows screen assemblies 20 in an undeformed state. Retractable members 32 are in a retracted position. When retractable members 32 are in the retracted position, screen assemblies 20 may be readily replaced. Screen assemblies 20 are placed in the vibratory screening machine 10 such that side members 28 contact angled surfaces 36 of central member 16. While the replaceable screen assemblies 20 are in the undeformed state, the retractable members 32 are brought into contact with screen assemblies 20. The angled surface 36 prevent side members 28 from deflecting in an upward direction. When compression arrangement 22 is actuated, retractable members 32 extend from the compression assembly 22 causing the overall horizontal distance between the retractable members and angled surfaces 36 to decrease. As the total horizontal distance decreases, the individual screen assemblies 20 deflect in a downward direction 29 contacting supporting surfaces 30 (as shown in FIG. 2). Angled surfaces 36 are also provided so that the screen assemblies 20 are installed in the vibrating screening machine 10 at a proper arc configuration. Different arc configurations may be provided based on the degree of extension of retractable members 32.

The extension of retractable members 32 is accomplished through constant spring pressure against the body of compression arrangement 22. The retraction of retractable members 32 is accomplished by mechanical actuation, electro mechanical actuation, pneumatic pressure or hydraulic pressure compressing the contained spring thereby retracting the retractable member 32 into the compression arrangement 22. Other extension and retractions arrangements may be used including arrangements configured for manual operation, etc. (see, e.g., FIGS. 6 to 8). The compression assembly 22 may also include a mechanism for adjusting the amount of deflection imparted to the screen assemblies 20. Additionally, the amount of deflection imparted to the screen assemblies 20 may be adjusted by a user selectable force calibration.

Figure 4:
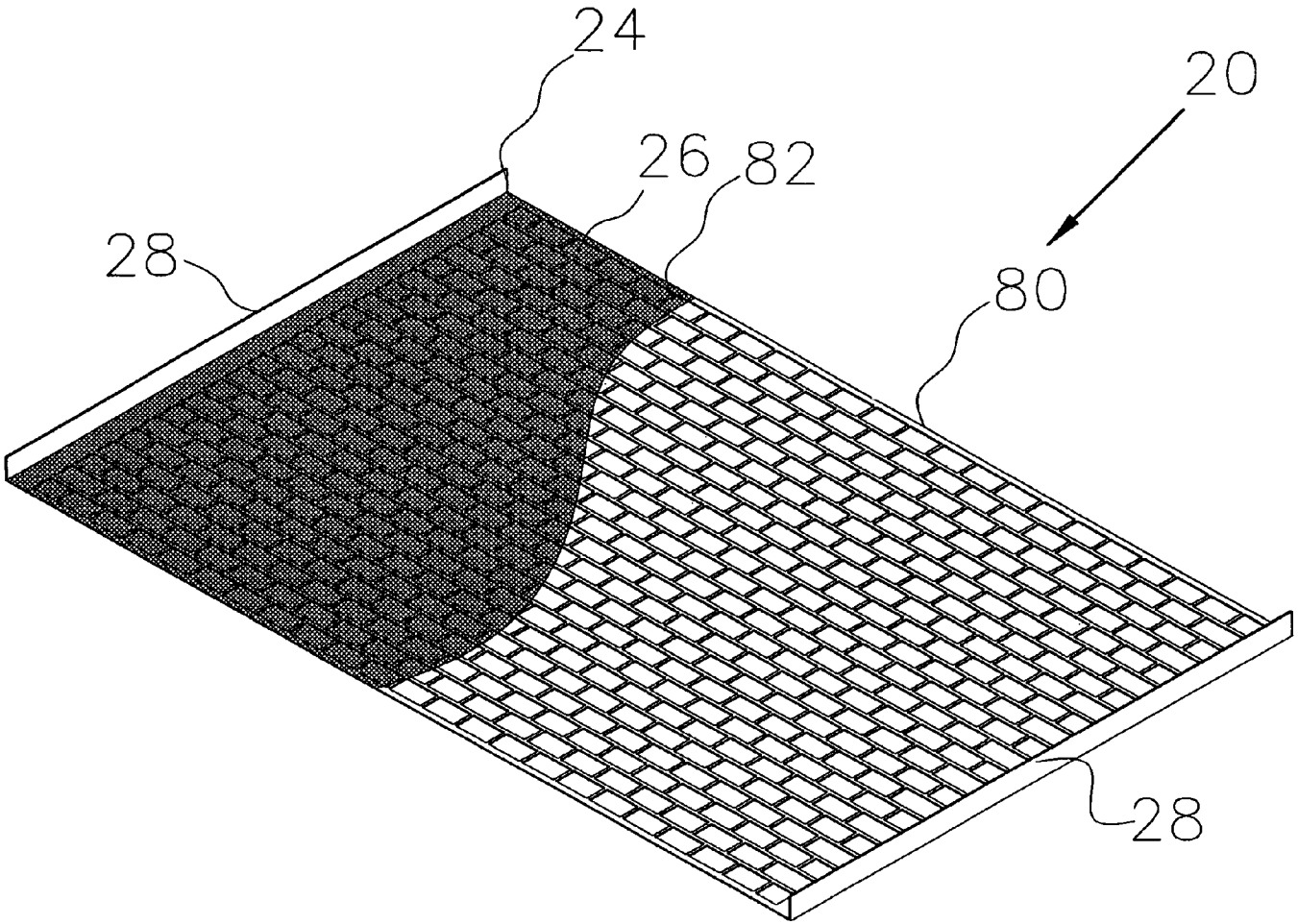
FIG. 4 shows a perspective view of a replaceable screen assembly according to an example embodiment of the present invention.

FIG. 4 shows a replaceable screen assembly 20. Screen assembly 20 includes frame 24 and screen 26. Frame 24 includes side members 28. Frame 24 includes a semi-rigid perforated support plate 80 and screen 26 includes a woven mesh material 82 on a surface of the support plate 80. Screen 26 is supported by frame 24. Screen assembly 20 is configured to form a predetermined concave shape when placed in a vibratory screening machine and subjected to appropriate forces.

Figure 5:
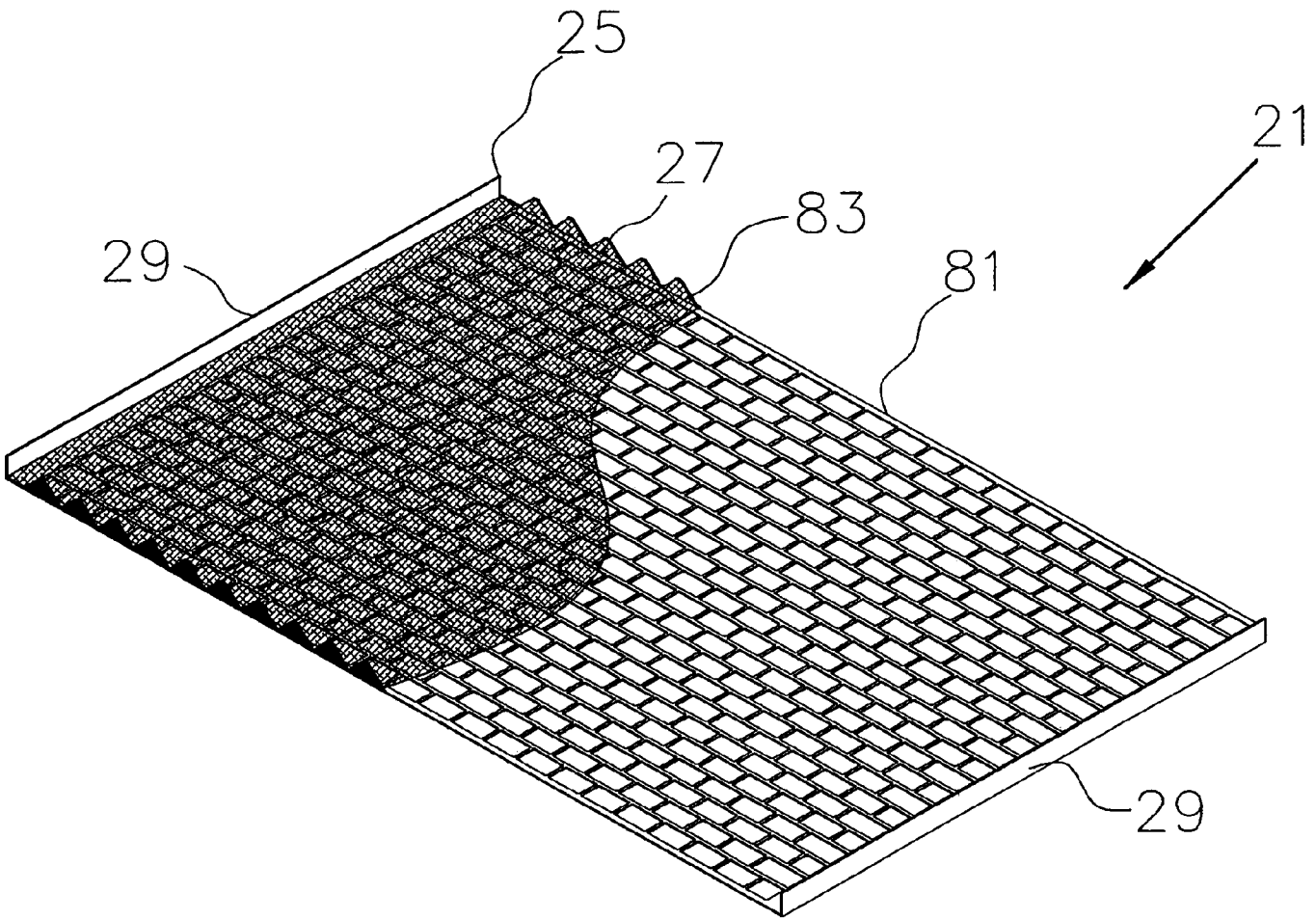
FIG. 5 shows a perspective view of a replaceable screen assembly according to an example embodiment of the present invention.

FIG. 5 shows a replaceable screen assembly 21. Screen assembly 21 includes frame 25 and an undulating screen 27. Frame 25 includes side members 29 and a semi-rigid perforated support plate 81. Undulating screen 27 includes a woven mesh material 83 on a surface of the support plate 81. Undulating screen 27 is supported by frame 25. Screen assembly 21 is configured to form a predetermined concave shape when placed in a vibratory screening machine and subjected to appropriate forces.

Figure 6:
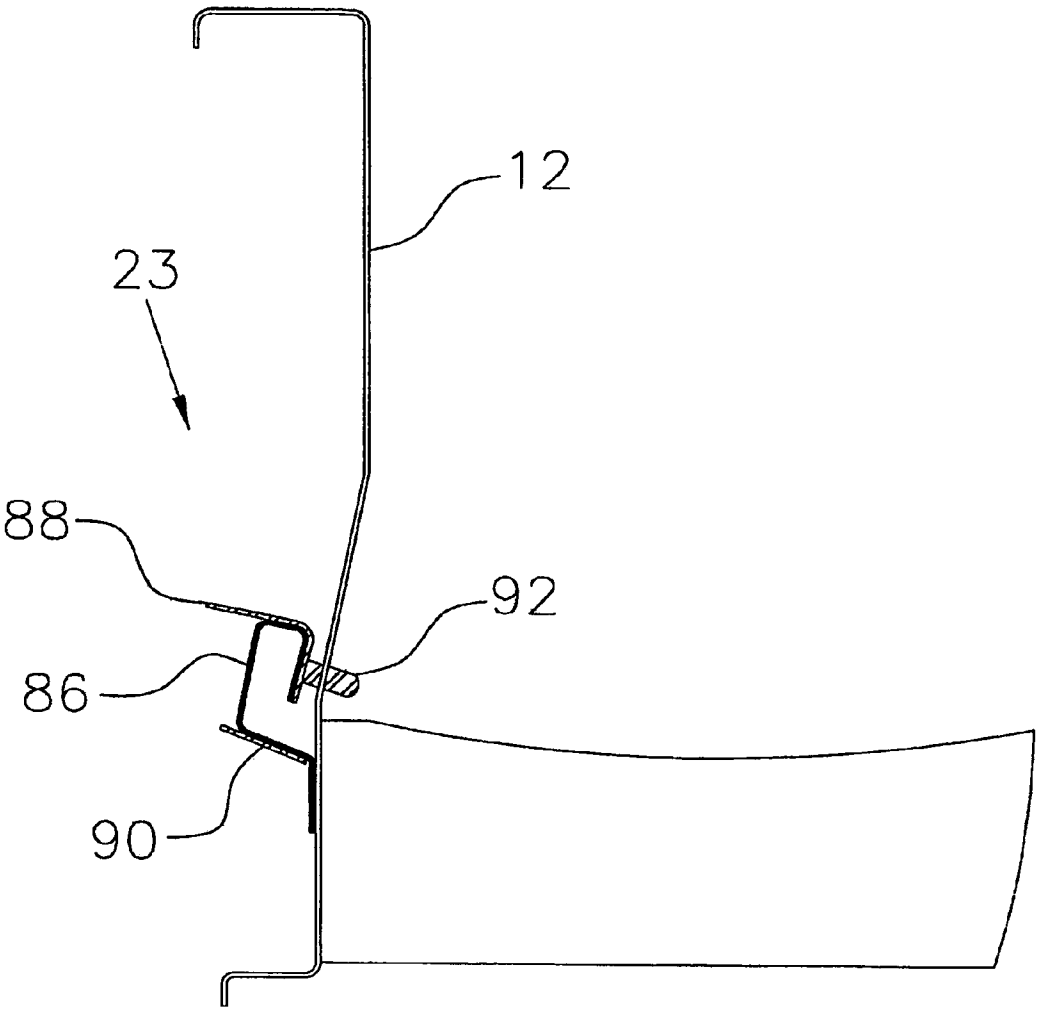
FIG. 6 shows a cross-sectional view of a portion of a vibratory screen machine with a pre-compressed spring compression assembly with a pin in an extended position.
Figure 7:
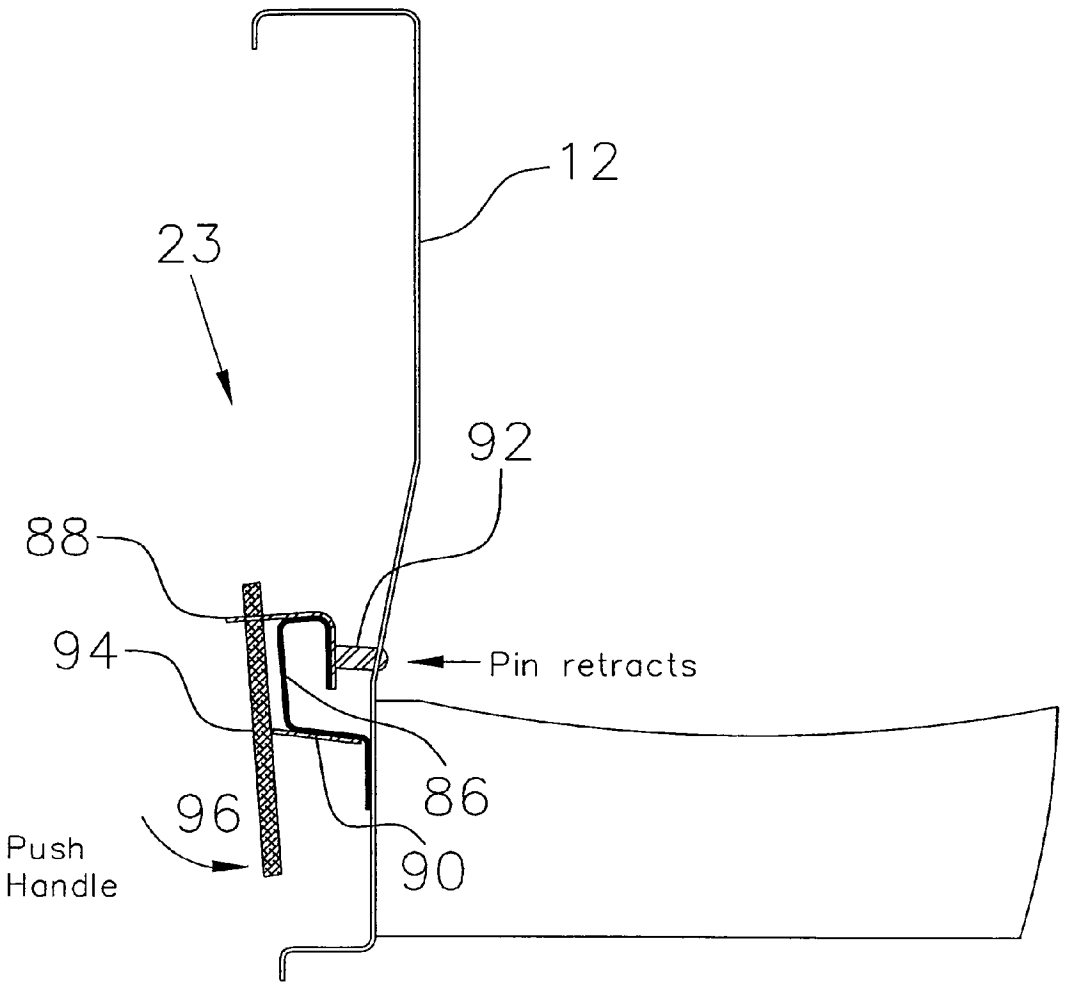
FIG. 7 shows a cross-sectional view of the vibratory screen machine shown in FIG. 6 with the pin in a retracted position.
Figure 8:
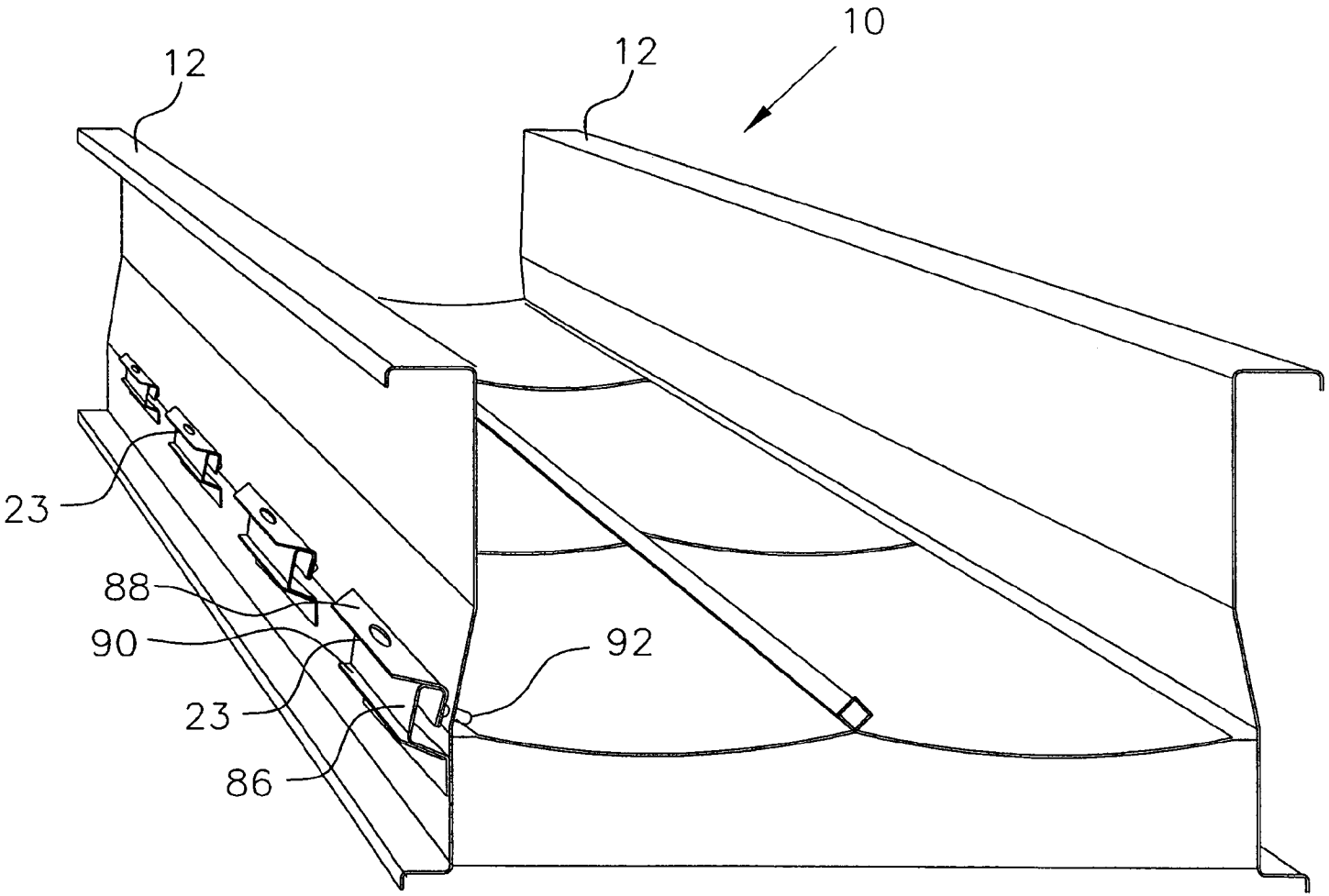
FIG. 8 shows a perspective view of a vibratory screen machine.

FIGS. 6 to 8 show a pre-compressed spring compression assembly 23. Pre-compressed spring compression assembly 23 may be used in place of or in conjunction with compression assembly 22. Pre-compressed spring compression assembly includes a spring 86, a retractor 88, a fulcrum plate 90 and a pin 92. Pre-compressed spring compression assembly 23 is attached to wall member 12 of vibratory screen machine 10.

In FIG. 6, pre-compressed spring compression assembly 23 is shown with pin 92 in an extended position. In this position, pin 92 asserts a force against a screen assembly such that the screen assembly forms a concave shape.

In FIG. 7, pin 92 is shown in a retracted position. To retract pin 92 a push handle 94 is inserted into an aperture in retractor 88 and pressed against fulcrum plate 90 in direction 96. The force on retractor 88 causes spring 86 to deflect and pin 92 to retract. A surface may be provided to secure pre-compressed spring compression assembly 23 in the retracted position. Although a simple lever retracting system is shown, alternative arrangements and systems may be utilized.

In FIG. 8, vibratory screen machine is shown with multiple pre-compressed spring compression assemblies 23. Each compression assembly may correspond to a respective screen assembly 20 so that installation and replacement of screen assembly 20 requires retraction of a single corresponding compression assembly 23. Multiple pins 92 may be provided in each of pre-compressed spring compression assemblies 23. As set forth above, other mechanical compression assemblies may be utilized.

Figure 9:
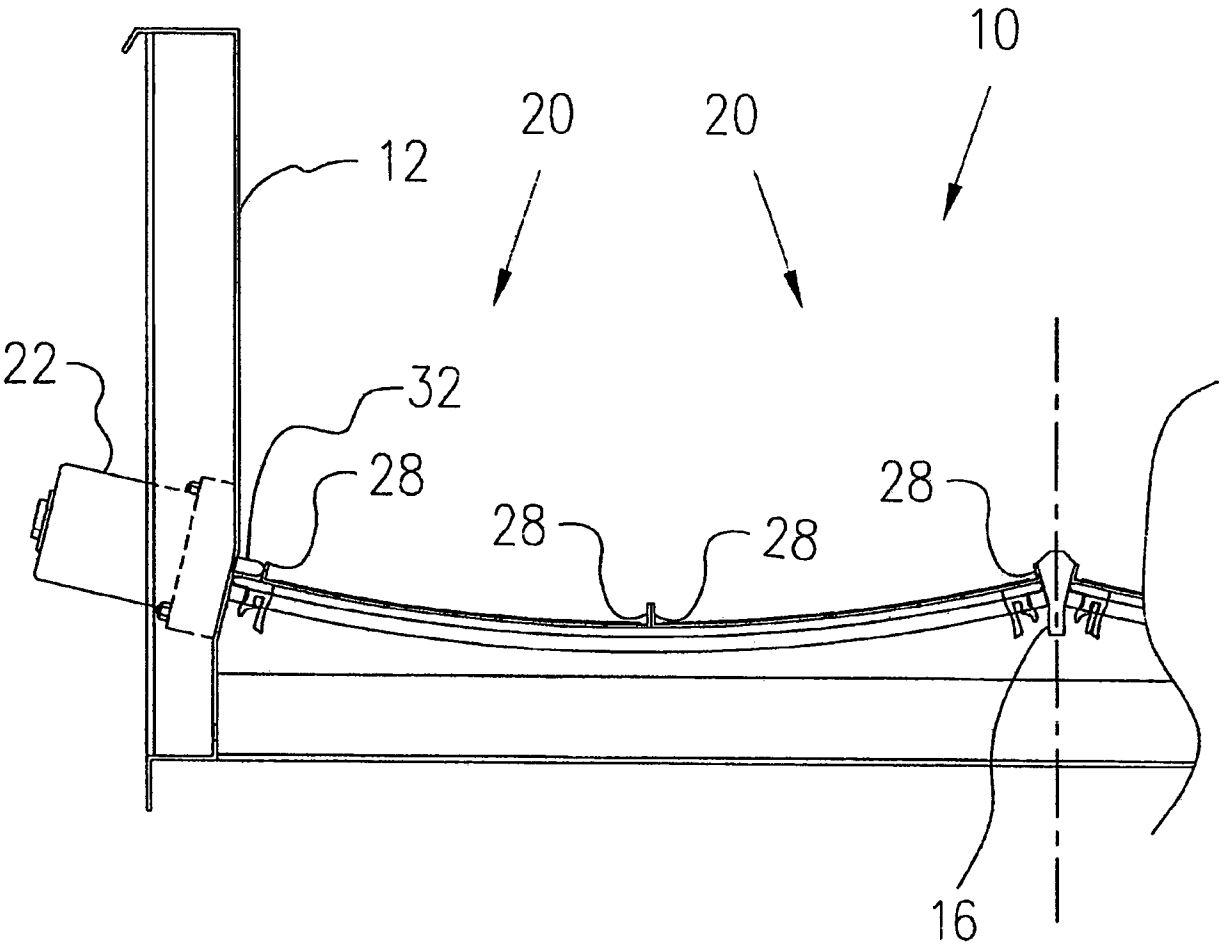
FIG. 9 shows a cross-sectional view of the vibratory screening machine according to an embodiment of the present invention.

FIG. 9 shows vibratory screening machine 10 with multiple screen assemblies 20 forming a concave surface. The first screen assembly 20 has one side member 28 in contact with pin members 32 and another side member 28 in contact with a side member 28 of a second screen assembly 20. The second screen assembly 20 has another side member 28 in contact with central member 16. As shown, pin members 32 are in the extended position and screen assemblies 20 are formed into a concave shape. The force asserted by pin members 32 cause screen assemblies 20 to push against each other and central member 16. As a result, the screen assemblies deflect into a single concave shape. The side members 28 that are in contact with each other may include brackets or other securing mechanisms configured to secure the screen assemblies 20 together. Although two screen assemblies are shown, multiple screen assemblies may be provided in similar configurations. The use of multiple screen assemblies may provide for reduced weight in handling individual screen assemblies as well as limiting the amount of screening area that needs to be replaced when a screen assembly becomes damaged or worn.

Figure 10:
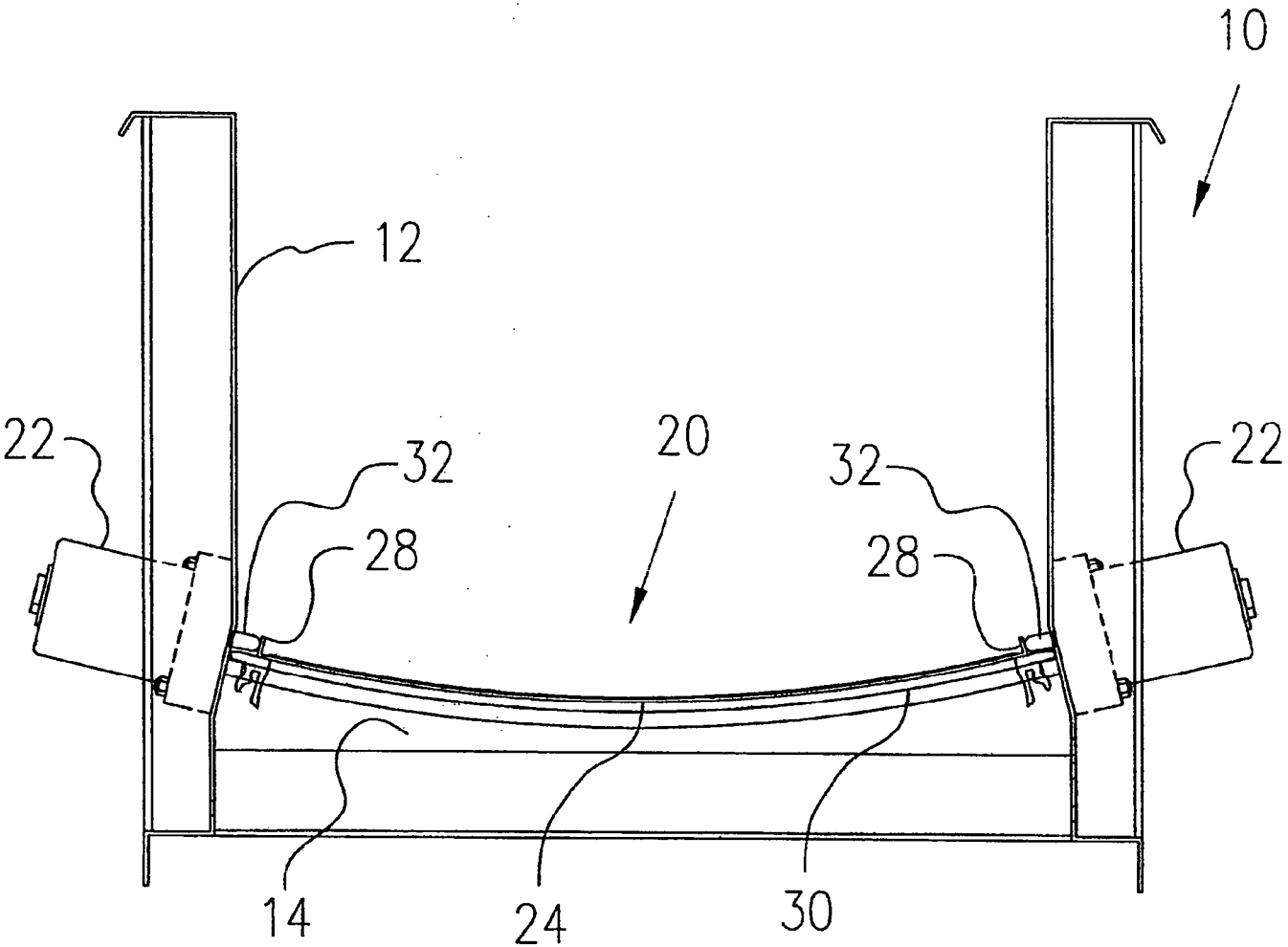
FIG. 10 shows a cross-sectional view of a vibratory screen machine according to an embodiment of the present invention.

FIG. 10 shows vibratory screen machine 10 without a central member. Vibratory screen machine 10 includes at least two compression assemblies 22 that have retractable members 32 that extend toward each other. Retractable members 32, which are illustrated in the extended position, assert a force against side members 28 of screen assemblies 20 causing screen assemblies 20 to form a concave shape against support surfaces 14.

A method for screening materials includes attaching a screen assembly to a vibratory screen machine and forming a top screening surface of the screen assembly into a concave shape. The method may also include accelerating or vibrating the screen assembly, feeding material along the concave top surface of the screen assembly, screening the material, returning the screen assembly to its original shape and replacing the screen assembly with another screen assembly.

In the foregoing example embodiments are described. It will, however, be evident that various modifications and changes may be made thereunto without departing from the broader spirit and scope hereof. The specification and drawings are accordingly to be regarded in an illustrative rather than in a restrictive sense.

What is claimed is:

1. A vibratory screen machine, comprising:

a wall member;

a concave support surface;

a central member;

a screen assembly including a frame having a plurality of side members and a screen supported by the frame, the screen including a semi-rigid support plate and a woven mesh material on a surface of the support plate;

a compression assembly attached to an exterior surface of the wall member, the compression assembly including a retractable member that advances and contracts; and an acceleration arrangement configured to impart an acceleration to the screen assembly, wherein as the retractable member advances it pushes the frame against the central member forming the screen assembly into a concave shape against the concave mating surface, the top surface of the screen assembly forming a concave screening surface.

2. A vibratory screen machine, comprising:

a screen assembly; and a compression assembly, wherein the compression assembly deforms a top surface of the screen assembly into a concave shape.

3. The vibratory screen machine according to claim 2, wherein the screen assembly includes a frame having a plurality of side members and a screen supported by the frame.

4. The vibratory screen machine according to claim 2, further comprising a wall member, wherein the compression assembly is attached to at least one wall member.

5. The vibratory screen machine according to claim 2, further comprising an acceleration arrangement configured to impart an acceleration to the screen assembly.

6. The vibratory screen machine according to claim 2, further comprising a support surface, wherein the screen assembly forms a concave shape against the support surface.

7. The vibratory screen machine according to claim 4, further comprising a central member, the screen assembly arranged between the central member and the wall members.

8. The vibratory screen machine according to claim 7, wherein a side member of a frame of the screen assembly is in contact with the central member and another side member of the frame of the screen assembly is in contact with the compression assembly.

9. The vibratory screen machine according to claim 7, further comprising at least one additional screen assembly including a second frame having a plurality of second side members and a second screen supported by the second frame, wherein a second side member of the additional screen assembly is in contact with the central member and a side member of the screen assembly is in contact with the compression assembly, the top surfaces of the at least two screen assemblies formed into a concave shape.

10. The vibratory screen machine according to claim 8, further comprising a second compression assembly; and a second screen assembly including a plurality of second side members, wherein a second side member of the second screen assembly is in contact with the central member and another second side member of the second screen assembly is in contact with the second compression assembly.

11. The vibratory screen machine according to claim 7, wherein the central member is attached to the support surface.

12. The vibratory screen machine according to claim 7, wherein the central member includes at least one angled surface configured to urge the screen assembly into the concave shape in accordance with deformation of the screen assembly by the compression assembly.

13. The vibratory screen machine according to claim 3, wherein at least one side member is at least one of a tube member, a formed box member and a formed flange.

14. The vibratory screen machine according to claim 2, further comprising a mating surface configured to contact the screen assembly.

15. The vibratory screen machine according to claim 14, wherein the mating surface includes at least one of rubber, aluminum and steel.

16. The vibratory screen machine according to claim 15, wherein the mating surface is a concave surface.

17. The vibratory screen machine according to claim 2, wherein the at least one compression assembly includes a pre-compressed spring configured to assert a force against the screen assembly.

18. The vibratory screen machine according to claim 17, wherein the pre-compressed spring asserts a force against at least one side of the frame.

19. The vibratory screen machine according to claim 2, wherein the compression assembly includes a mechanism configured to adjust an amount of deflection imparted to the screen assembly.

20. The vibratory screen machine according to claim 19, wherein the amount of deflection imparted to the screen is adjustable by a user selectable force calibration.

21. The vibratory screen machine according to claim 4, wherein the compression assembly is positioned on an exterior of a wall member.

22. The vibratory screen machine according to claim 2, wherein the compression assembly includes a retractable member that advances and contracts.

23. The vibratory screen machine according to claim 22, wherein the retractable member advances and contracts by at least one of a manual force, a hydraulic force and a pneumatic force.

24. The vibratory screen machine according to claim 2, further comprising at least one additional compression assembly, the compression assemblies configured to provide a force in the same direction.

25. A screen assembly for a vibratory screening machine, comprising:

a frame including a plurality of side members; and a screen supported by the frame, wherein the screen assembly is configured to form a predetermined concave shape when subjected to a compression force by a compression assembly of the vibratory screening machine against at least one side member of the screen assembly when placed in the vibratory screening machine.

26. The screen assembly according to claim 25, wherein the predetermined concave shape is determined in accordance with a shape of a surface of the vibratory screening machine.

27. The screen assembly according to claim 25, wherein at least two side members are at least one of tube members, box members and formed flanges.

28. The screen assembly according to claim 25, further comprising a mating surface configured to interact with a surface of the vibratory screening machine.

29. The screen assembly according to claim 28, wherein the mating surface includes at least one of rubber, aluminum and steel.

30. The screen assembly according to claim 25, wherein the frame includes a perforated semi-rigid support plate and formed flanges on at least two sides.

31. The screen assembly according to claim 25, wherein the frame includes a perforated semi-rigid support plate and the screen includes a woven mesh material, wherein the woven mesh material is attached to the support plate by at least one of gluing, welding and mechanical fastening.

32. The screen assembly according to claim 25, wherein the screen includes at least two layers of woven mesh material.

33. The screen assembly according to claim 25, wherein the screen includes at least two layers of woven mesh material and the frame includes a semi-rigid perforated support plate.

34. The screen assembly according to claim 25, wherein the frame includes a semi-rigid perforated support plate and the screen includes at least two layers of a woven mesh material in an undulating shape, wherein the at least two layers of woven mesh material are attached to the support plate by at least one of gluing, welding and mechanical fastening.

35. The screen assembly according to claim 25, wherein the plate includes a semi-rigid perforated support plate and the screen includes at least three layers of a woven mesh material in an undulating shape, wherein the at least three layers of woven mesh material are attached to the support plate by at least one of gluing, welding and mechanical fastening.

36. A method for screening materials, comprising:

attaching a screen assembly to a vibratory screen machine; and forming a top screening surface of the screen assembly into a concave shape.

37. The method of claim 36, further comprising vibrating the screen assembly.

38. The method of claim 36, further comprising:

returning the screen assembly to an original shape;

replacing the screen assembly with another screen assembly; and performing the attaching and forming steps on another screen assembly.

* * * * *